US008696334B2

(12) United States Patent
Hunt et al.

(10) Patent No.: US 8,696,334 B2
(45) Date of Patent: Apr. 15, 2014

(54) SUBMERSIBLE PUMPING SYSTEM WITH HEAT TRANSFER MECHANISM

(75) Inventors: Daniel Francis Alan Hunt, Houston, TX (US); F. Coyne Prenger, Boulder, CO (US); Dallas D. Hill, Los Alamos, NM (US); Todd Andrew Jankowski, Los Alamos, NM (US)

(73) Assignees: Chevron U.S.A. Inc., San Ramon, CA (US); Los Alamos National Security, LLC, Los Alamos, NM (US)

( * ) Notice: Subject to any disclaimer, the term of this patent is extended or adjusted under 35 U.S.C. 154(b) by 1308 days.

(21) Appl. No.: 12/111,926

(22) Filed: Apr. 29, 2008

(65) Prior Publication Data

US 2009/0269224 A1 Oct. 29, 2009

(51) Int. Cl.
*F04D 29/58* (2006.01)
*F03B 11/00* (2006.01)

(52) U.S. Cl.
USPC ..... 417/423.8; 417/423.3; 417/423.11; 166/62

(58) Field of Classification Search
USPC ..... 417/423.3, 423.8, 423.11, 423.15, 360, 417/368; 310/54, 63; 166/60, 62; 165/272
See application file for complete search history.

(56) References Cited

U.S. PATENT DOCUMENTS

| | | | | |
|---|---|---|---|---|
| 2,080,678 | A | 5/1937 | Van Horn et al. | |
| 2,285,436 | A | 6/1942 | Hoover | |
| 2,295,418 | A * | 9/1942 | Mims | 166/155 |
| 2,556,435 | A | 6/1951 | Moehrl et al. | |
| 3,242,360 | A | 3/1966 | Carle | |
| 3,671,786 | A | 6/1972 | Jones | |
| 4,286,185 | A | 8/1981 | Erickson | |
| 4,413,671 | A * | 11/1983 | Basiulis | 165/104.27 |
| 4,425,087 | A * | 1/1984 | Gould | 417/414 |
| 4,685,867 | A * | 8/1987 | Patun et al. | 417/367 |
| 4,930,996 | A * | 6/1990 | Jensen et al. | 417/373 |
| 5,348,452 | A * | 9/1994 | Yamamoto et al. | 417/422 |
| 6,705,254 | B1 * | 3/2004 | Grabowski et al. | 123/41.29 |
| 7,492,069 | B2 | 2/2009 | Knox et al. | |
| 7,597,138 | B1 * | 10/2009 | Koenig | 166/62 |
| 8,037,936 | B2 | 10/2011 | Neuroth et al. | |
| 2010/0244595 | A1 | 9/2010 | Sheth | |

OTHER PUBLICATIONS

Jankowski et al., Development and Validation of a Thermal Model for Electric Induction Motors, IEEE Transactions on Industrial Electronics, Jan. 14, 2012.

(Continued)

*Primary Examiner* — Charles Freay
*Assistant Examiner* — Philip Stimpert
(74) *Attorney, Agent, or Firm* — Pillsbury Winthrop Shaw Pittman LLP

(57) ABSTRACT

A submersible pumping system for downhole use in extracting fluids containing hydrocarbons from a well. In one embodiment, the pumping system comprises a rotary induction motor, a motor casing, one or more pump stages, and a cooling system. The rotary induction motor rotates a shaft about a longitudinal axis of rotation. The motor casing houses the rotary induction motor such that the rotary induction motor is held in fluid isolation from the fluid being extracted. The pump stages are attached to the shaft outside of the motor casing, and are configured to impart fluid being extracted from the well with an increased pressure. The cooling system is disposed at least partially within the motor casing, and transfers heat generated by operation of the rotary induction motor out of the motor casing.

11 Claims, 5 Drawing Sheets

(56) References Cited

OTHER PUBLICATIONS

Page from Byron Jackson Brochure, Nov. 2010; http://www.flowserve.com/files/Files/Literature/ProductLiterature/Pumps/fpd-1361-ea4.pdf.

Flowserve Brochure, Byron Jackson Electrical Submersible Pumps and Oil-Filled Motors, Nov. 2012.

Flowserve Brochure, Byron Jackson Electrical Submersible Pumps and Oil-Filled Motors, Feb. 2010.

* cited by examiner

SUBMERSIBLE PUMPING SYSTEM WITH HEAT TRANSFER MECHANISM

U.S. GOVERNMENT RIGHTS

This invention was made with government support under a Contract No. DE-AC52-06NA25396 awarded by the U.S. Department of Energy. The government has certain rights in the invention.

FIELD OF THE INVENTION

The invention relates to submersible pumping systems for downhole implementation in the extraction of fluids containing hydrocarbons from wells.

BACKGROUND OF THE INVENTION

Submersible pumps (e.g., electric submersible pumps, electric submersible progressive cavity pumps, etc.) are widely used "downhole" within a well bore to extract water, oil, gas, suspended solids, and/or other materials from the well bore. These pumping systems are typically constructed as combined, integral units that include a motor that drives a long, small diameter, multi-staged centrifugal pump. The motor is generally around 20 feet long, and typically is less than about 7.5 inches in diameter. The narrow diameter of the motor is crucial to the functionality of the pumping system, which is lowered into the well bore and submerged in the fluid being extracted. This is because the cross-sectional footprint of the motor assembly impedes the flow of the fluid being extracted.

Conventional submersible pumping systems are typically fairly robust devices, and the motors implemented therein tend to be formed from components and/or materials that are rugged. The reliability of the motor of a submersible pumping system is important because failures of the motor typically result in a substantial cost in time (during which the extraction of fluid is ceased or impaired), manpower, and/or materials. For example, as a result of a motor failure, a pump may have to be removed from the well bore, the motor serviced or replaced, and/or the pump reinserted into the well bore. As a result, there is a need for enhancing the reliability of conventional submersible pumping systems other than further improving the quality and ruggedness of their components and/or materials.

SUMMARY

One aspect of the invention relates to a submersible pumping system for downhole use in extracting fluids containing hydrocarbons from a well. In one embodiment, the pumping system comprises a rotary induction motor, a motor casing, one or more pump stages, and a heat transfer mechanism. The rotary induction motor rotates a shaft about a longitudinal axis of rotation. The motor casing houses the rotary induction motor such that the rotary induction motor is held in fluid isolation from the fluid being extracted. The pump stages are attached to the shaft outside of the motor casing, and are configured to impart fluid being extracted from the well with an increased pressure. The heat transfer mechanism is disposed at least partially within the motor casing, and transfers heat generated by operation of the rotary induction motor out of the motor casing.

Another aspect of the invention relates to a submersible pumping system for downhole use in extracting fluids containing hydrocarbons from a well. In one embodiment, the pumping system comprises a rotary induction motor, a motor casing, one or more pump stages, and a cooling system. The rotary induction motor rotates a shaft about a longitudinal axis of rotation. The motor casing houses the rotary induction motor such that the rotary induction motor is held in fluid isolation from the fluid being extracted. The pump stages are attached to the shaft outside of the motor casing, and are configured to impart fluid being extracted from the well with an increased pressure. The cooling system comprises a heat transfer mechanism that, upon activation, transfers heat within the motor casing that is generated by operation of the rotary induction motor out of the motor casing. The cooling system is configured such that the heat transfer mechanism is activated if a temperature within the motor casing rises above a predetermined threshold temperature. The predetermined threshold temperature is greater than the temperature within the motor casing during typical operation of the rotary induction motor for extraction of the hydrocarbon fluid from the well.

Another aspect of the invention relates to a submersible pumping system for downhole use in extracting fluids containing hydrocarbons from a well. In one embodiment, the pumping system comprises a rotary induction motor and one or more structures. The rotary induction motor rotates a shaft about a longitudinal axis of rotation. The structures transfer heat generated by operation of the rotary induction motor to a wall of the well via conduction or some other heat transfer mechanism, such as one or more heat pipes.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
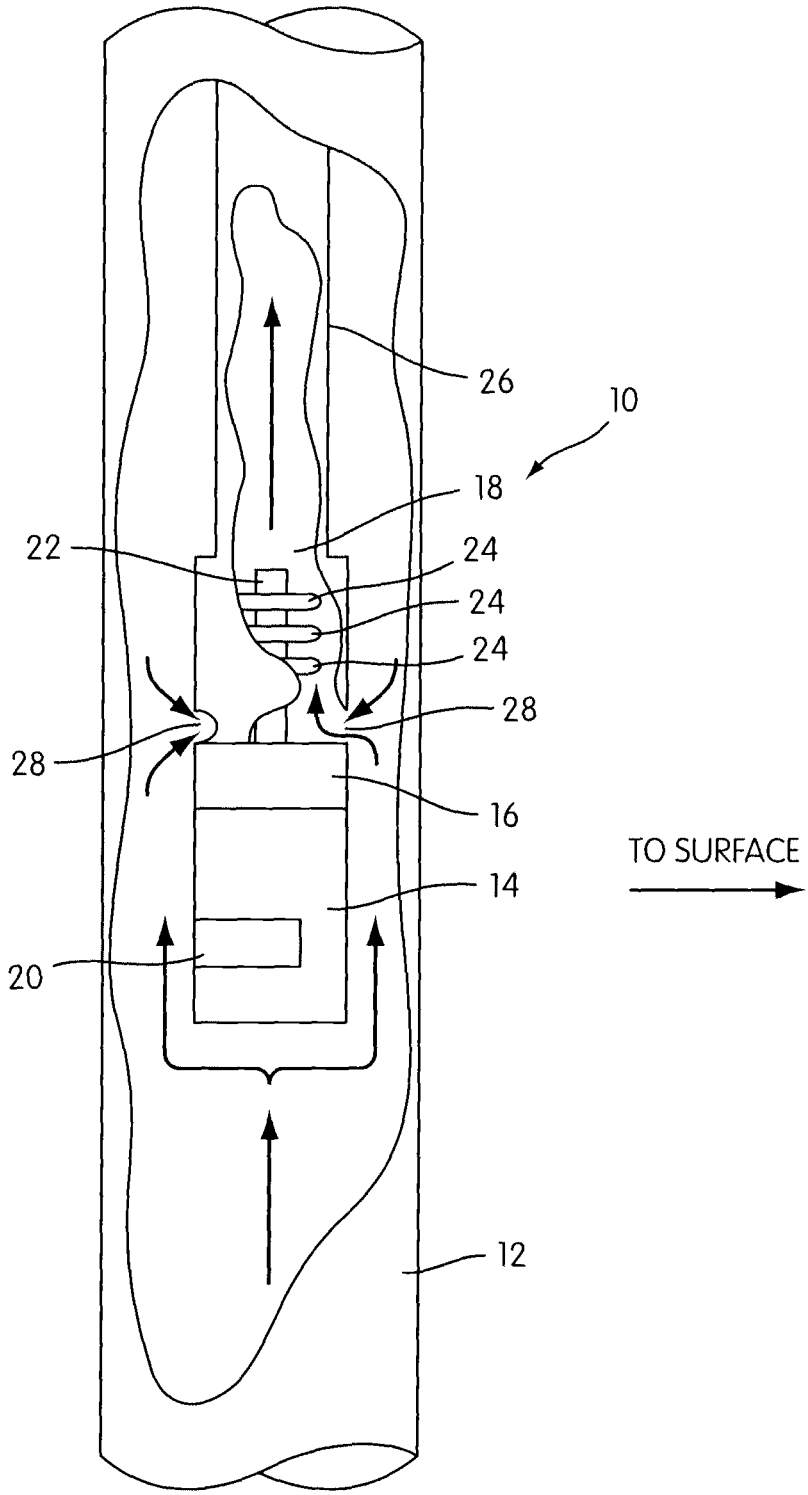
FIG. 1 illustrates a schematic representation of a submersible pumping system, in accordance with one or more embodiments of the invention.

FIG. 1 illustrates a schematic representation of a submersible pumping system 10, according to one or more embodiments of the invention. Pumping system 10 is designed for downhole use in extracting hydrocarbon fluids from a well formed by a well casing 12. As can be seen in FIG. 1, in some embodiments, pumping system 10 may include a motor 14, a seal 16, a pumping section 18, and a cooling system 20. Pumping system 10 is configured to propel the fluid being extracted toward the surface.

More specifically, motor 14 is configured to drive a shaft 22 rotationally about a longitudinal axis of rotation. In pumping section 18, the rotation of shaft 22 operates one or more centrifugal pump stages 24. A conduit 26 surrounds shaft 22 and pump stages 24 at pumping section 18, and guides the fluid being extracted from pumping section 18 to the surface. Conduit 26 forms one or more openings 28 through which fluid being extracted is received into pumping section 18 and is drawn toward shaft 22. As motor 14 drives shaft 22, impellers within pump stages 24 are rotated thereby increasing the kinetic energy of the fluid contained therein. Each of pump stages 24 further includes a diffuser, which then increases the pressure of the fluid with the increased kinetic energy. Under this increased pressure, the fluid is expelled from pump stages 24 and is forced away from pumping section 18 and along conduit 26.

It should be appreciated that this explanation of the operation of pumping system 10 is specific to a single type of submersible pumping systems that are implemented downhole, namely, electric submersible pumps. This is not intended to be limiting, as the scope of this disclosure includes other types of submersible pumping systems implemented downhole for the extraction of fluids that contain hydrocarbons, such as, for example, electric submersible progressive cavity pumps. Further, the principles disclosed herein may also be extended to other downhole systems, besides pumping systems, that implement rotary motors of a limited cross-sectional area.

Conventional submersible pumping systems generally rely on the flow of the fluid along the surface of the motor housing and through pumping system 10 to dissipate heat generated during operation. As such, discontinuities in the flow rate and/or other properties of the fluid being extracted may cause temperatures within these conventional pumping systems, and in particular within the motors of these pumping systems, to spike. In contrast, pumping system 10 includes cooling system 20, which implements one or more techniques to either increase the amount of thermal ballast for motor 14 and/or to enhance the thermal coupling between the fluid being extracted and motor 14 (e.g., via the techniques described below) in order to avoid one or more complications discovered to be a result of temperature spikes within pumping system 10. For example, it has been discovered that temperature spikes within pumping system 10 caused by discontinuities in the properties of the fluid being extracted, if not properly compensated for by cooling system 20, may shorten the operational life of pumping system 10 and/or lead to failures of pumping system 10.

Figure 2:
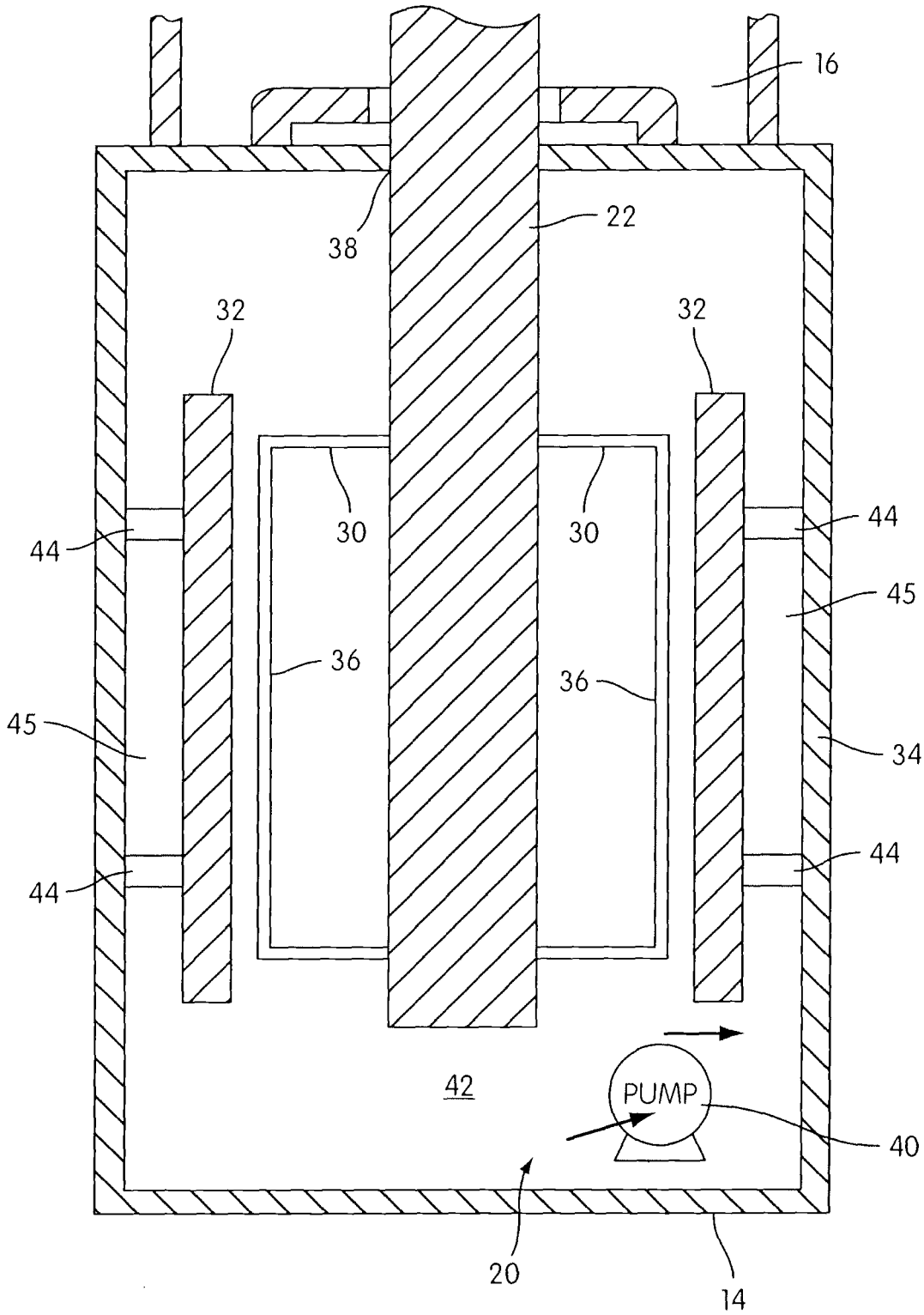
FIG. 2 illustrates a schematic representation of a motor for powering a submersible pumping system, according to one or more embodiments of the invention.

FIG. 2 illustrates a schematic diagram of motor 14, in accordance with one or more embodiments of the invention. As was mentioned above, motor 14 is configured to drive shaft 22 about its axis of rotation. Motor 14 comprises a rotary induction motor that includes a rotor 30, a stator 32, a motor casing 34, and/or other components.

Rotor 30 is attached to, and/or formed on, shaft 22. In an exemplary embodiment, rotor 30 is a squirrel cage rotor that is cylindrical, and is disposed about shaft 22. Rotor 30 includes a ferromagnetic material so as to be driven by a fluctuating magnetic field. For example, in one embodiment, rotor 30 includes one or more bars 36 of electrically conductive material. As the magnetic field around rotor 30 fluctuates, a current is induced in bars 36 that interacts with the fluctuating magnetic field to produce a magnetic force that rotates rotor 30 (and with it shaft 22) about its longitudinal axis. It should be appreciated that the illustration in FIG. 2 of a squirrel cage rotor 30 is not intended to be limiting, and in other implementations different types of rotors may be implemented, including rotors made up of one or more hard magnetic materials, slip ring rotors, and/or other rotors.

Stator 32 comprises one or more cylindrical field magnets configured to generate a magnetic field within motor 14 that will drive the rotation of rotor 30. In one embodiment, the field magnet(s) of stator 32 are formed from one or more field windings about the cylinder(s), through which an electrical current is generated in order to produce the magnetic field that drives the rotation of rotor 30. In one embodiment, the electrical current is supplied directly to the field winding(s) of stator 32. However, it should be appreciated that other configurations are contemplated by this disclosure, such as the application of electrical current to rotor 30 in a slip ring configuration, the implementation of one or more hard magnetic materials to form stator 32 rather than field windings, and/or other configurations.

Motor casing 34 houses the other components of motor 14, and holds these components in fluid isolation from the fluid being extracted from the well. Motor casing 34 may include an opening 38 through which shaft 22 extends. Because it may be preferable to maintain the fluid isolation of the inner components of motor 14 (e.g., rotor 30, stator 32, etc.) from the fluid being extracted from the well, seal 16 may form a seal around opening 38 and/or along an extended length of shaft 22 that prevents the fluid being extracted from entering motor casing 34. In some implementations (not shown in FIG. 2), seal 16 and/or motor casing 34 may be formed from a flexible material that places the interior of motor casing 34 in pressure communication with the fluid being extracted, but even in these implementations, the actual fluid being extracted is sealed off from coming into direct contact with the inner components of motor 14 (e.g., these components are still maintained in fluid isolation from the extracted fluid).

As should be appreciated, once pumping system 10 is installed within well casing 12, failure of motor 14 creates costs in time, money, and manpower, as fluid extraction must be halted while pumping system 10 is removed from well casing 12 to the surface, repaired and/or replaced, and reinstalled downhole. Further, the form factor of motor 14 is a primary design concern, as the amount of area taken up in the cross-section of well casing 12 by motor 14 (and pumping system 10 in general) will decrease the area of the cross-section of well casing 12 available to transport extracted fluid. Although the cross-section of well casing 12 could, in theory, be expanded to accommodate a motor and pump with a larger cross-section, such an expansion would be costly in terms of the process implemented to drill the well, and the apparatuses used for this purpose. Due to these and other considerations, some of the reasons that motor 14 typically comprises a rotary induction motor include the reliability and ruggedness of these types of motors, as well as their efficiency, and favorable form factor (narrow cross-section).

During typical operation, fluid being extracted from the well flows past motor casing 34 as a turbulent flow. Although the temperature of this fluid (which typically includes one or more of water, steam, liquid hydrocarbons, vapor hydrocarbons, suspended solids, and/or other materials) is generally between about 60-250° C., the robustness of rotary induction motors leads the designers of conventional submersible pumping systems to rely primarily on the flow of extracted fluid past motor casing 34 to cool motor 14. It has been discovered, however, that during operation, discontinuities in the flow and/or other properties of the extracted fluid past motor casing 34 may cause the temperature of motor 14 to spike and/or remain elevated as the heat transfer coefficient between the motor casing 34 and the flow of the extracted fluid past motor 14 is decreased (e.g., due to operational issues, changes in the properties of the fluid surrounding motor 14 such as the presence of a vapor plug within well casing 12 moving past pumping system 10, etc.). Additionally, it has been discovered that although the ruggedness of the rotary induction motors capable of operating at the elevated temperature conditions present within well casing 12, has traditionally been relied upon to withstand the temperature elevations and/or discontinuities caused by changes in properties of the flow of the fluid past pumping system 10, taking measures to enhance heat transfer from within motor 14 in order to reduce, regulate and/or stabilize the internal temperature of motor 14 may significantly prolong the life of motor 14 and/or reduce failures of motor 14.

As such, as was mentioned above with respect to FIG. 1, pumping system 10 further comprises cooling system 20. In the embodiment illustrated in FIG. 2, cooling system 20 comprises a fluid pump 40 that circulates an internal fluid within motor casing 34. The internal fluid is a non-magnetic fluid (so as not to interfere with the operation of rotor 30 and stator 32) that may provide lubrication to motor 14, in addition to temperature regulation. Fluid pump 40 may include one or more of a rotodynamic pump, a centrifugal pump, a positive displacement pump, a kinetic pump, and/or other pumps and/or modifications to the motor rotating elements, shaft 22 and/or rotor 36, capable of causing the internal fluid 42 to circulate within motor 14. In some implementations, fluid pump 40 may circulate the internal fluid at a rate of between about 1 and about 15 gallons per minute. In some implementations, fluid pump 40 may circulate the internal fluid at a rate greater than or equal to about 3 gallons per minute. In some implementations, fluid pump 40 may circulate the internal fluid at a rate greater than or equal to about 5 gallons per minute. Fluid pump 40 may be powered separately from motor 14, or fluid pump 40 may be powered by the rotation of shaft 22 by motor 14, and may draw a parasitic load therefrom.

The circulation of the internal fluid caused by fluid pump 40 may transfer heat generated during operation of motor 14 around rotor 30 and/or stator 32 to areas closer to motor casing 34 (e.g., so that the heat can be transferred to the fluid being extracted from the well). For example, the heat generated around rotor 30 and/or stator 32 may be transferred to space 42 toward the end of motor 14 farthest from the surface opening of the well. Motor casing 34 may be constructed such that space 42 forms a reservoir that acts as an intermediate heat sink, holding some of the heat generated around rotor 30 and/or stator 32 as this heat is carried by the internal fluid within space 42 to motor casing 34. In one embodiment, the volume of space 42 is at least about 1 liter. In one embodiment, the volume of space 42 is at least about 2 liters. In one embodiment, the volume of space 42 is at least about 3 liters.

In order to further facilitate the circulation of the internal fluid within motor casing 34, cooling system 20 may include one or more structures 44 that suspend stator 32 at some distance from motor casing 34 to form one or more flow paths 45 between stator 32 and motor casing 34. Flow paths 45 may be configured to enable the internal fluid to circulate relatively freely between stator 32 and motor casing 34, providing an effective convective heat transfer coupling between the circulating internal fluid and motor casing 34, while structures 44 are configured to still provide adequate mechanical support between stator 32 and motor casing 34. Although structures 44 are illustrated in FIG. 2 as struts extending between stator 32 and motor casing 34, this is not intended to be limiting. Any other structure capable of forming flow paths 45 may be implemented with and/or in place of the struts shown in FIG. 2. For example, in one implementations, structures 44 may form flow paths 45 along predetermined convective pathways designed to enhance the transfer of heat from stator 32.

In one embodiment, the cross-sectional area of flow paths 45 taken on a plane perpendicular to the longitudinal axis of pumping system 10 is between about 0.5 and about 2 square inches. In one embodiment, the cross-sectional area of flow paths 45 taken on a plane perpendicular to the longitudinal axis of pumping system 10 is between about 1 and about 2 square inches. In one embodiment, the cross-sectional area of flow paths 45 taken on a plane perpendicular to the longitudinal axis of pumping system 10 is at least about 2 square inches. In one embodiment, structures 44 are formed from a thermally conductive material that conducts heat from stator 32 to motor casing 34 by conduction.

It should be appreciated that while conventional submersible pumping systems may include an internal fluid within the motor, the primary function of this internal fluid is as a lubricant. As such, the internal fluid in a conventional submersible pumping system is provided and circulated within the motor casing to prolong the life of the motor through lubrication, and not through heat transfer. For this reason, even if the motor of a conventional submersible pumping system includes a fluid pump within the motor casing to circulate the internal fluid, such a pump would only provide a level of circulation capable of preventing degradation and/or sludging of the internal fluid, or to enable filtration of the internal fluid, and not the enhanced level of circulation provided by fluid pump 40 of cooling system 20.

In some embodiments of the invention, cooling system 20 includes one or more heat transfer mechanisms that are disposed partially within motor casing 34, extend out of motor casing 34, and are configured to transfer heat inside motor casing 34 to a heat sink outside of motor casing 34. The heat sink may include the fluid being extracted, well casing 12, phase-change thermal capacitive heat sink disposed close to or in contact with the one or more heat transfer mechanisms, and/or other heat sinks. By way of non-limiting example, cooling system 20 may include one or more heat pipes at least partially disposed within motor casing 34.

Figure 3:
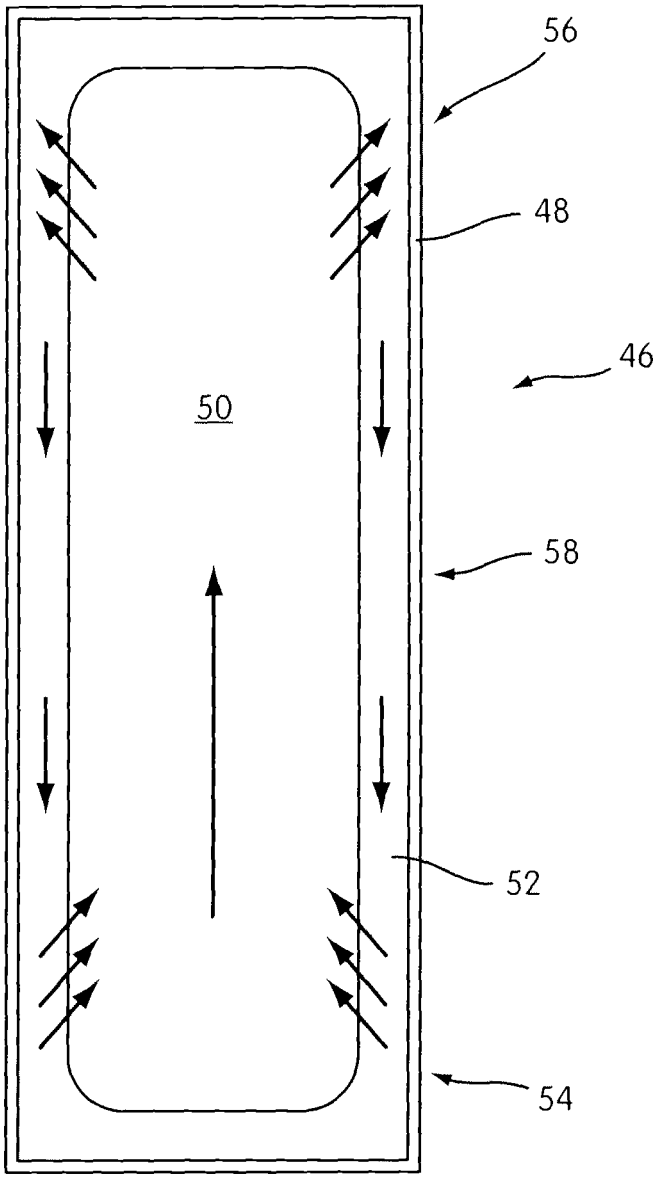
FIG. 3 illustrates a schematic representation of a heat pipe, according to one or more embodiments of the invention.

FIG. 3 illustrates a schematic representation of the operation of a heat pipe 46, according to one or more embodiments of the invention. Heat pipe 46 may operate in accordance with the principles discussed in U.S. Pat. No. 3,229,759, which is entitled "Evaporation-Condensation Heat Transfer Device" ("the '759 Patent"). The disclosure of the '759 Patent is hereby incorporated into this disclosure in its entirety. As shown in FIG. 3, heat pipe 46 comprises a casing 48, an open volume 50, a wick 52, an evaporation section 54, a condensation section 56, and an adiabatic section 58. It should be appreciated that heat pipe 46 has been illustrated as a particular type of relatively rudimentary heat pipe, and that this should not limit the types of heat pipe(s) that may be implemented in cooling system 20 within the scope of this disclosure.

Casing 48 provides a barrier between the interior of heat pipe 46 and the exterior of heat pipe 46 that is sealed and relatively inelastic. Casing 48 is formed from one or more materials that enable casing 48 to retain its strength at the elevated temperatures and pressures on and around evaporation section 54, and around condensation section 56. For example, in one embodiment, casing 48 is formed from one or more of higher thermal conductivity alloys of copper or aluminum where attention is paid to mating the thermal expansion coefficients of the proposed materials to that of motor casing 34.

Within casing 48, a working fluid is disposed. Due to the sealed nature of casing 48, the working fluid and/or any other substances present within casing 48 are held in isolation from any substances present without casing 48. Evaporation section 54 is disposed in a region (e.g., within motor casing 34) where temperatures are elevated, and from which heat will be transferred by heat pipe 46. Due to the elevation of temperatures in evaporation section 54, the working fluid present within evaporation section 54 is evaporated. Condensation section 56 is disposed at or near the heat sink (e.g., the fluid being extracted within well casing 12, well casing 12, a phase-change heat sink, other parts of pumping system 10, etc.) to which heat pipe 46 will be transferring heat. As a result, the temperature of condensation section 56 need be only slightly lower than at evaporation section 54 before the working fluid undergoes a phase change and is condensed at condensation section 56.

During operation, the working fluid circulates within heat pipe 46 in accordance with the arrows shown in FIG. 3. More specifically, condensed working fluid within evaporation section 54 is evaporated, and migrates within open volume 50 through adiabatic section 58 to condensation section 56. In condensation section 56, the vaporized working fluid is condensed, and makes its way back through adiabatic section 58 to evaporation section 54 to repeat the process. In some instances, wick 52 draws the condensed fluid toward evaporation section 54. In some instances, other forces, such as gravity, centrifugal forces, and/or other forces, are used for the liquid return. In this manner the working fluid transfers heat from evaporation section 54 to condensation section 56. The working fluid of heat pipe 46 may be selected such that it will have an appropriate boiling point to transfer heat as part of cooling system 20 (shown in FIG. 1). For example, the working fluid of heat pipe 46 may include one or more of water, methanol, benzene, certain Dowtherm products, and/or other materials. It should be appreciated that the operating temperature of heat pipe 46 is also a function of the pressure within heat pipe 46. In one embodiment, heat pipe 46 is configured such that the operating temperature of heat pipe 46 is between about 30° C. and about 250° C.

Referring back to FIG. 1, in some implementations, cooling system 20 comprises one or more heat transfer mechanisms that would effectively add thermal mass to motor 14 by thermally linking motor casing 34 with other structural elements of pumping system 10. For example, one or more heat pipes, such as heat pipe 46 described above and/or variable conductance heat pipe 59 discussed below, may be used to thermally link various structural elements of pumping system 10 with motor 14. This thermal linking between motor 14 and other elements of pumping system 10 would enable pumping system 10 to behave as an isothermal ensemble, thereby adding thermal ballast to motor 14 and increasing the effective thermal mass of motor 14 and/or pumping system 10, and reducing temperature excursions resulting from temporary degradation of the heat sink provided by the fluid being extracted (for example, a vapor plug within well casing 12 moving past pumping system 10).

In some implementations, cooling system 20 comprises one or more heat transfer mechanisms that regulate the temperature within motor 14 (e.g., within motor casing 34 shown in FIG. 2) to reduce spikes in temperatures within motor 14. As such, cooling system 20 may include one or more heat transfer mechanisms that activate to begin transferring heat out of motor 14 if a temperature within motor 14 rises above a predetermined threshold. As was mentioned above, it has been discovered that the spiking of temperatures within motor 14 (e.g., where a temperature spike is a sudden increase and then eventual decrease of the temperature within motor 14) may significantly shorten the life of motor 14 and/or lead to failures of motor 14. Thus, the predetermined threshold may be selected to be a temperature that is greater than a typical operating temperature of motor 14, and these selectively activated one or more heat transfer mechanisms may only be activated as the temperature rises above the predetermined threshold to reduce any harmful effects of temperature spiking within motor 14. By way of non-limiting example, the typical operating temperature of motor 14 may be between about 180° C. and about 220° C., and the predetermined threshold may be between about 185° C. and about 240° C. Similarly, by way of non-limiting example, the predetermined threshold may be selected to be between about 5° C. and about 40° C. greater than the typical operating temperature of motor 14. In one embodiment, the predetermined threshold may be selected to be at least about 15° C. greater than the typical operating temperature of motor 14. In one embodiment, the predetermined threshold may be selected to be at least about 10° C. greater than the typical operating temperature of motor 14. In one embodiment, the predetermined threshold may be selected to be between about 2% and about 20% (in ° C.) greater than the typical operating temperature of motor 14. In one embodiment, the predetermined threshold may be selected to be at least about 5% greater (in ° C.) than the typical operating temperature of motor 14. In one embodiment, the predetermined threshold may be selected to be at least about 10% greater (in ° C.) than the typical operating temperature of motor 14. In one embodiment, the predetermined threshold may be selected to be at least about 15% (in ° C.) greater than the typical operating temperature of motor 14.

Figure 4:
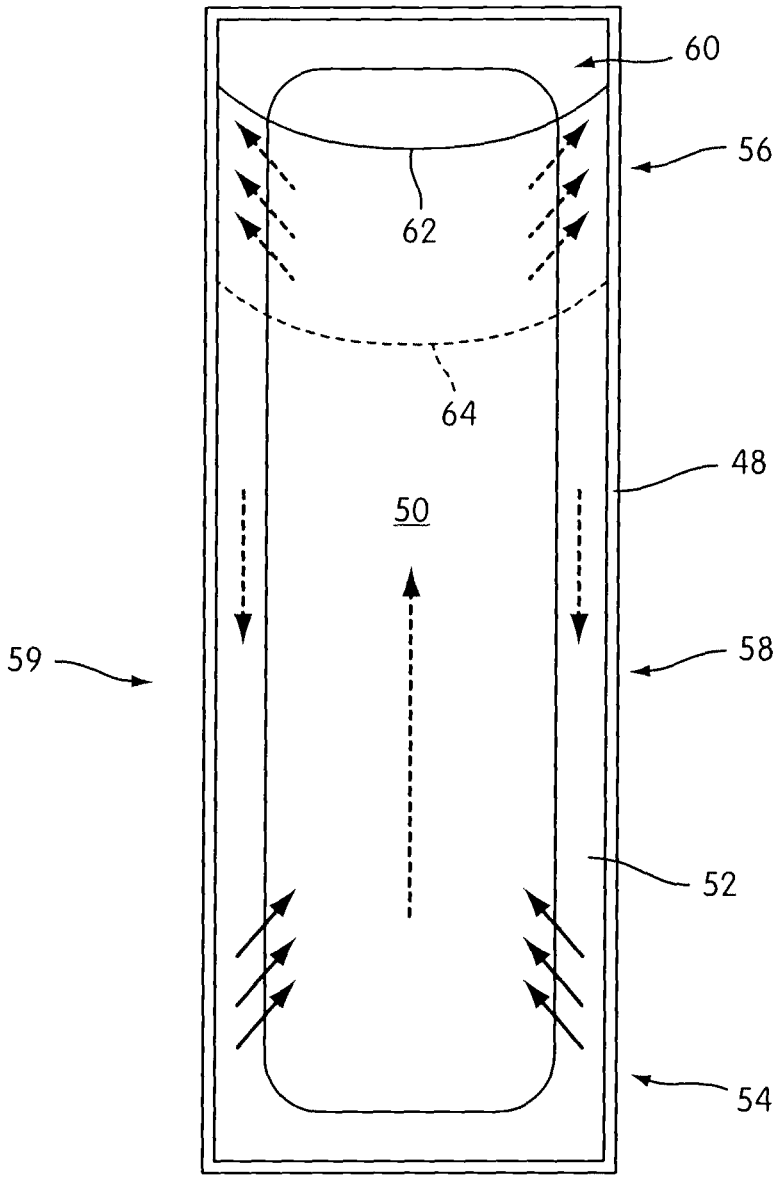
FIG. 4 illustrates a schematic representation of a variable conductance heat pipe, in accordance with one or more embodiments of the invention.

To accomplish the above described temperature control, FIG. 4 illustrates a schematic representation of a variable conductance heat pipe 59 where components similar to heat pipe 46 illustrated in FIG. 3 have been provided with the same reference characters. Variable conductance heat pipe 59 is configured to activate at a predetermined threshold temperature. To facilitate activation at the predetermined threshold temperature, a body of fluid 60 that is non-condensing at the intended operating temperature of heat pipe 59 is included within casing 48. Non-condensing fluid 60 is a fluid with a critical point that is much lower than the working fluid within casing 48. Consequently, as the working fluid circulates within variable conductance heat pipe 59 to transfer heat, non-condensing fluid 60 remains a super-heated gas, and is pushed by the circulation of the vapor phase of the working fluid into a relatively homogeneous body located at the end of condensation section 56. As temperatures fluctuate within variable conductance heat pipe 59, the pressure within variable conductance heat pipe 59 also varies, with higher temperatures (e.g., as temperatures within the motor rise) resulting in higher pressure within variable conductance heat pipe 59, and lower temperatures within variable conductance heat pipe 59 resulting in lower pressure.

At a relatively high (for the intended operating conditions of variable conductance heat pipe 59) temperature, the pressure within variable conductance heat pipe 59 increases, and compresses non-condensing fluid 60 into the region illustrated in FIG. 4 as region 60. While non-condensing fluid 60 is compressed within region 62, condensation section 56 is available to the working fluid within casing 48, and the working fluid circulates in accordance with the arrows illustrated in FIG. 4 (dashed and solid) allowing for heat transfer between the evaporation section 54 to condensation section 56, thereby cooling evaporation section 54. However, at a lower temperature, the pressure within variable conductance heat pipe 59 drops, and the body of non-condensing fluid 60 expands to the region illustrated in FIG. 4 as region 64. With non-condensing fluid 60 occupying region 64, condensation section 56 is no longer available to the working fluid, and, as a result, the working fluid is suspended in evaporation section 54 and adiabatic section 58, and no substantial heat transfer takes place between evaporation section 54 and condensation section 56. It should be appreciated that this temperature-pressure feedback mechanism of the working fluid together with the accompanying volume change of non-condensing fluid 60 provides a relatively precise passive temperature control feature for variable conductance heat pipe 59.

In one or more embodiments, the composition and/or amount of non-condensing fluid 60 introduced into variable conductance heat pipe 59 is selected such that variable conductance heat pipe 59 will be activated (e.g., condensation section 56 will be available to the working fluid) if the temperature within the motor (e.g., motor 14, illustrated in FIGS. 1 and 2, and described above) in which variable conductance heat pipe 59 is installed rises above a predetermined threshold, such as the predetermined threshold discussed above. Similarly, the amount and/or composition of non-condensing fluid 60 is selected such that if the temperature within the motor is below the predetermined threshold, non-condensing fluid 60 will expand and cover evaporation section 54, thereby deactivating variable conductance heat pipe 59. Some non-limiting examples of the composition of non-condensing fluid 60 include argon, neon, xenon, and/or helium.

Returning to FIG. 1, as was mentioned previously, cooling system 20 may include a heat pipe, such as heat pipe 46 shown in FIG. 3 and/or variable conductance heat pipe 59 shown in FIG. 4, both of which are described above, that is installed at least partially within motor 14 to transfer heat out of motor 14. For example, in one embodiment, shaft 22 may house a heat pipe. In this embodiment, the evaporation section of the heat pipe would be formed by the portion of shaft 22 that is disposed within motor 14 (to receive a torque therefrom), and the condensation section of the heat pipe would be formed by the portion of shaft 22 that extends out into pumping section 18 and communicates with the fluid being extracted (this effectively increases the thermal communication with the traditional extracted-fluid heat sink). Such a configuration would not require the insertion of components that take up additional volume within motor 14 and/or well casing 12, and would not significantly weaken shaft 22, provided the casing of the shaft remained of sufficient thickness and/or composition. Further, this configuration would transfer heat from the hottest part of the motor, around shaft 22, to the traditional heat sink of pumping system 10, namely, the fluid being extracted.

In such implementations, the rotation of shaft 22 (in the absence of, or in conjunction with porous wick structures) could be used to draw the working fluid in its liquid phase from the condensation section to the evaporation section of the heat pipe. For example, shaft 22 could be a hollow shaft of constant wall thickness, whereby, the working fluid would form a variable thickness liquid film along the inner wall of shaft 22, with a thick liquid film in condensation section and a relatively thin liquid film in the evaporator section. The rotation of shaft 22 would then generate a hydrostatic pressure difference between the condensation and evaporation sections, returning the liquid phase working fluid to the evaporation section. In some instances, forming shaft 22 with a heat pipe having an internal surface that has a continuous taper or discrete steps from a larger diameter at the end within motor 14 to a smaller diameter at the end disposed in pumping section 18 such that a component of the centrifugal force applied to the liquid by the rotation of shaft 22 would force the liquid along the casing of shaft 22 from pumping section 18 toward motor 14, where it could again be evaporated. U.S. Pat. No. 7,168,480, which is entitled "Off-Axis Cooling of Rotating Devices Using a Crank-Shaped Heat Pipe" ("the '480 Patent"), discloses a heat pipe that implements centrifugal force to move a working fluid within a heat pipe. The '480 Patent hereby incorporated into this disclosure in its entirety.

It should be appreciated that this implementation of a heat pipe within cooling system 20 is not intended to be limiting. One or more heat pipes may be installed at other positions partially, or even wholly, within motor 14 to transfer heat away from the components of motor 14 where heat is generated. For example, one or more heat pipes could be disposed within motor 14 such that their condensation sections extend out "upstream" from pumping system 10 into the fluid being extracted. Such a configuration would not increase the cross-sectional footprint of pumping system 10 within well casing 12, and would place the condensation section(s) of the heat pipe(s) in contact with the fluid prior to the passage of the fluid over motor 14. Other implementations of heat pipes within cooling system 20 are also contemplated.

Similarly, the implementation of the fluid being extracted as a heat sink to which cooling system 20 transfers heat from motor 14 should not be viewed as limiting the scope of this disclosure. It is contemplated that in some instances, cooling system 20 may include a heat sink to which heat may be transferred. For example, where cooling system 20 includes a heat pipe that protrudes from motor 14, the protruding end may be placed in communication (e.g., via conduction) with a heat sink. The heat sink may be a phase-change thermal capacitive heat sink, such as a paraffin wax or some other suitable substance, which could be melted to absorb the heat transferred out of motor 14. While such a heat sink may eventually be depleted during operation, it may be useful in instances where cooling system 20, or a portion of cooling system 20, is activated at temperatures that are higher than typical operating temperatures (e.g., the predetermined threshold) to help regulate the temperature of motor 14 for relatively short periods of time (e.g., during temperature spikes caused by discontinuities in the properties of the flow of fluid being extracted).

Figure 5:
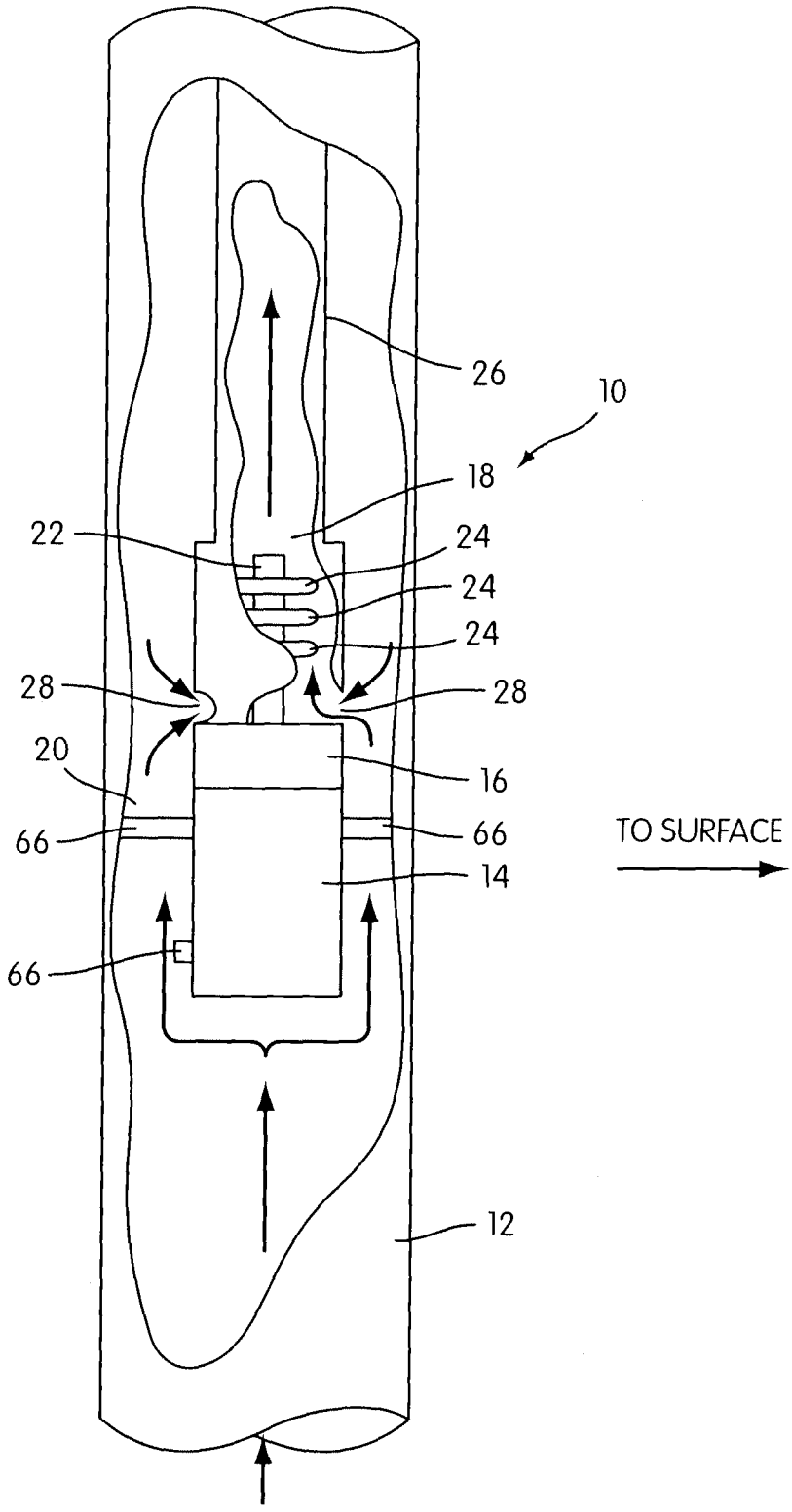
FIG. 5 illustrates a schematic representation of a submersible pumping system, according to one or more embodiments of the invention.

FIG. 5 illustrates a schematic representation of pumping system 10, in accordance with one or more embodiments of the invention. In the embodiment(s) illustrated in FIG. 5, cooling system 20 is configured to transfer heat generated by motor 14 to well casing 12. The heat transfer may come from direct contact with well casing 12 (e.g., via conduction), rather than relying on convection of the fluid being extracted. For example, in one embodiment, cooling system 20 includes one or more structures 66 that extend from motor 14 to well casing 12. In some instances, structures 66 may extend from a casing of motor 14, or structures 66 may extend into the interior of motor 14, to draw heat from motor 14 out to well casing 12.

In one embodiment, structures 66 include structures that are thermally conductive. In one embodiment, structures 66 include structures that actively transfer heat from motor 14 to well casing 12, such as, for example, a heat pipe. Since pumping system 10 must be insertable into, and removable from well casing 12, structures 66 may be collapsible and/or retractable (e.g., via some sort of spring loading, such as pressure induced spring loading) to engage and/or disengage well casing 12 during installation and/or uninstallation. For example, structures 66 may be telescoping and/or pivotable with pneumatic activation to collapse and/or retract from well casing 12.

To some extent, the presence of structures 66 between pumping system 10 and well casing 12 may impede, at least to some degree, the flow of the fluid being extracted by pumping system 10. As a result, the number and configuration (e.g., shape, thickness, location, etc.) of structures 66 may be selected to balance the benefit provided by the heat transfer accomplished via structures 66 versus the impact on the flow of the fluid being extracted.

It should be appreciated that the above-described heat transfer mechanisms described as being included within cooling system 20 (e.g., fluid 42 and fluid pump 40 shown in FIG. 2, heat pipe 46 shown in FIGS. 3 and 4, structures 66 shown in FIG. 5, etc.) are not a comprehensive enumeration of the heat transfer mechanisms that may be implemented to reduce and/or regulate the temperature within motor 14 within the scope of this disclosure. Further, although these mechanisms have, at least to some extent, been illustrated and described separately, this is not intended to be limiting, as various combinations of heat transfer mechanisms may be implemented within a single design of cooling system 20 where such combination enhances the functionality of cooling system 20 and/or pumping system 10.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A submersible pumping system for downhole use in extracting fluids containing hydrocarbons from a well, the pumping system comprising:

a rotary induction motor that rotates a shaft about a longitudinal axis of rotation;

a motor casing that houses the rotary induction motor such that the rotary induction motor is held in fluid isolation from the fluid being extracted;

one or more pump stages attached to the shaft outside of the motor casing, the one or more pump stages being configured to impart fluid being extracted from the well with an increased pressure; and a heat transfer mechanism disposed at least partially within the motor casing that transfers heat generated by operation of the rotary induction motor out of the motor casing, wherein the heat transfer mechanism comprises a fluid pump disposed within the motor casing that is physically separate and disconnected from the shaft and powered separately from the motor, the fluid pump being configured to circulate a reservoir of internal fluid within the motor casing to form a convective thermal coupling between working components of the rotary induction motor and the motor casing, and wherein the reservoir of internal fluid is held internally within the motor casing.

2. The pumping system of claim 1, wherein the heat transfer mechanism further comprises a heat pipe, and wherein the heat pipe includes a section in thermal communication with the internal fluid circulating within the motor casing.

3. The pumping system of claim 2, wherein the heat pipe is formed within the shaft rotated by the rotary induction motor.

4. The pumping system of claim 2, wherein the heat pipe comprises an evaporation section formed in a portion of the heat pipe that is disposed within the motor casing in thermal communication with the internal fluid circulating within the motor casing, and a condensation section formed in a portion of the heat pipe that is disposed outside of the motor casing.

5. The pumping system of claim 1, wherein the fluid pump operates to circulate the internal fluid within the motor casing at a displacement rate of between about 1 gallon per minute and about 15 gallons per minute.

6. The pumping system of claim 1, wherein the fluid pump operates to circulate the internal fluid within the motor casing at a displacement rate of at least about 3 gallons per minute.

7. The pumping system of claim 1, further comprising one or more flow paths formed between a stator of the rotary induction motor and the motor casing such that the internal fluid circulates through the one or more flow paths.

8. The pumping system of claim 5, wherein the cumulative cross-sectional area of the one or more flow paths on a plane that is perpendicular to the longitudinal axis of the rotary induction motor is between about 0.5 and about 2 square inches.

9. A submersible pumping system for downhole use in extracting fluids containing hydrocarbons from a well, the pumping system comprising:

a rotary induction motor that rotates a shaft about a longitudinal axis of rotation;

a motor casing that houses the rotary induction motor such that the rotary induction motor is held in fluid isolation from the fluid being extracted;

one or more pump stages attached to the shaft outside of the motor casing, the one or more pump stages being configured to impart fluid being extracted from the well with an increased pressure; and a cooling system comprising a variable conductance heat pipe at least partially disposed within the motor casing, the heat pipe encasing a volume of non-condensing fluid that does not condense during operation of the heat pipe such that the volume of non-condensing fluid causes the heat pipe to be activated responsive to the temperature within the motor casing rising above a predetermined threshold temperature, wherein, upon activation, the heat pipe transfers heat within the motor casing that is generated by operation of the rotary induction motor out of the motor casing, and wherein the predetermined threshold temperature is between 2% and 20% in degrees Celsius greater than the temperature within the motor casing during typical operation of the rotary induction motor for extraction of the hydrocarbon fluid from the well.

10. The pumping system of claim 9, wherein the temperature within the motor casing during typical operation of the rotary induction motor for extraction of the hydrocarbon fluid from the well is between about 180° C. to about 220° C., and wherein the predetermined temperature threshold is between about 185° C. to about 240° C.

11. The pumping system of claim 9, wherein the predetermined temperature threshold is between about 5° C. to about 20° C. greater than the temperature within the motor casing during typical operation of the rotary induction motor for extraction of the hydrocarbon fluid from the well.

* * * * *